US006530643B1

(12) United States Patent
Askren et al.

(10) Patent No.: US 6,530,643 B1
(45) Date of Patent: Mar. 11, 2003

(54) ROTARY WIPING ASSEMBLY FOR A NOZZLE PLATE IN AN INK JET PRINTER

(75) Inventors: Benjamin Alan Askren, Lexington, KY (US); Laura Garcia Baxter, Lexington, KY (US); Curtis Ray Droege, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/710,110

(22) Filed: Nov. 9, 2000

(51) Int. Cl.[7] ..... B41J 2/165
(52) U.S. Cl. ..... 347/33
(58) Field of Search ..... 347/33, 32

(56) References Cited

U.S. PATENT DOCUMENTS

| | | | | |
|---|---|---|---|---|
| 4,144,537 A | | 3/1979 | Kimura et al. | |
| 4,500,895 A | * | 2/1985 | Buck et al. | 347/87 |
| 5,051,758 A | * | 9/1991 | Markham | 347/33 X |
| 5,115,250 A | | 5/1992 | Harmon et al. | |
| 5,432,539 A | | 7/1995 | Anderson | |
| 5,608,432 A | * | 3/1997 | Yamaguchi | 347/33 |
| 5,949,448 A | | 9/1999 | Man et al. | |
| 5,969,731 A | | 10/1999 | Michael et al. | |

FOREIGN PATENT DOCUMENTS

| | | |
|---|---|---|
| JP | 4-141440 A | 5/1992 |
| JP | 05-278224 A | 10/1993 |
| JP | 06-255117 A | 9/1994 |

* cited by examiner

*Primary Examiner*—Anh T. N. Vo

(57) ABSTRACT

An ink jet printer for printing on a print medium includes an ink jet cartridge assembly movable at a scan velocity in scan directions. The ink jet cartridge assembly includes a nozzle plate. A rotary wiper is positioned in association with the nozzle plate for contacting the nozzle plate. The rotary wiper is rotatable with a tangential velocity which is greater than the scan velocity.

8 Claims, 3 Drawing Sheets

ROTARY WIPING ASSEMBLY FOR A NOZZLE PLATE IN AN INK JET PRINTER

BACKGROUND OF THE INVENTION

1. Field of the Invention

The present invention relates to ink jet printers, and, more particularly, to a wiping assembly for wiping a nozzle plate in an ink jet printer.

2. Description of the Related Art

An ink jet printer typically includes an ink jet cartridge assembly with a printhead mounted under a body. The body includes one or more ink reservoirs which are in fluid communication with the printhead. The printhead includes a plurality of heaters which are respectively positioned in association with nozzles in a nozzle plate. The heaters are selectively actuated during printing to jet ink droplets from the corresponding nozzles in the nozzle plate.

The nozzle plate and nozzles may become contaminated over time as a result of ink residue and other contaminants which accumulate adjacent the nozzles as a result of printing operations. Such contamination may reduce print quality or entirely prevent printing. It is thus known to periodically clean the nozzle plate to remove contamination therefrom.

A conventional wiping assembly for cleaning a nozzle plate includes a wiping blade which is positioned in association with the nozzle plate. The wiping blade includes a linear wiping edge which contacts and cleans the nozzle plate as the ink jet cartridge assembly is moved past the wiping blade during a cleaning operation. A problem with this type of wiping assembly is that the contamination removed from one part of the nozzle plate may be smeared and deposited on another part of the nozzle plate. More particularly, as shown in FIG. 1, a nozzle plate typically includes multiple arrays of ink jetting nozzles which are positioned generally parallel to each other and transverse to the scan direction of the nozzle plate. As the nozzle plate is moved in a scan direction through the cleaning station to contact the wiper blade, the wiping edge of the blade contacts a first array of the nozzles in the nozzle plate. The ink residue and other contaminants removed from the first array of nozzles remain on the wiping edge of the wiper blade. As the ink cartridge assembly continues to move past the wiper blade, the ink residue and other contaminants may be smeared and/or deposited on an adjacent array of nozzles. Moreover, the ink residue and other contaminants may in fact fill or clog other nozzles in the nozzle plate, thereby resulting in poor print quality.

It is also known to use a rotary wiper to remove contaminants from a nozzle plate in an ink jet cartridge assembly. Such rotary wipers include a pair of flexible blades which only intermittently contact the nozzle plate. The intermittent contact provided by the flexible blades may not effectively clean the nozzle plate. Moreover, the flexible blades wipe multiple arrays of nozzles before the blades are cleaned, thereby possibly resulting in contamination of adjacent arrays of nozzles the same as described above when using a linear wiper blade.

What is needed in the art is a wiper assembly for wiping a nozzle plate in an ink jet printer which effectively removes ink residue and contaminants while preventing cross-contamination of adjacent nozzle arrays.

SUMMARY OF THE INVENTION

The present invention provides a wiping assembly for an ink jet printer including a rotary wiper with a helical-shaped wiping edge which moves with a tangential velocity greater than the scan velocity of the ink jet cartridge assembly.

The invention comprises, in one form thereof, an ink jet printer for printing on a print medium, including an ink jet cartridge assembly movable at a scan velocity in scan directions. The ink jet cartridge assembly includes a nozzle plate. A rotary wiper is positioned in association with the nozzle plate for contacting the nozzle plate. The rotary wiper is rotatable with a tangential velocity which is greater than the scan velocity.

The invention comprises, in another form thereof, an ink jet printer for printing on a print medium. The ink jet printer includes an ink jet cartridge assembly with a nozzle plate. A rotary wiper is positioned in association with the nozzle plate. The rotary wiper has a radially outwardly extending wiping edge for contacting the nozzle plate. The wiping edge has a generally helical shape about the rotary wiper.

An advantage of the present invention is that the rotary wiper moves with a tangential velocity which is greater than a scan velocity of the ink jet cartridge assembly, thereby preventing transfer of the ink residue and other contaminants from one nozzle array to an adjacent, parallel nozzle array.

Another advantage is that the rotary wiper is formed with a helical wiping edge which allows continuous rotary motion.

A further advantage is that a helical wiping edge may be configured with a flat, curved, etc. distal contacting surface.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
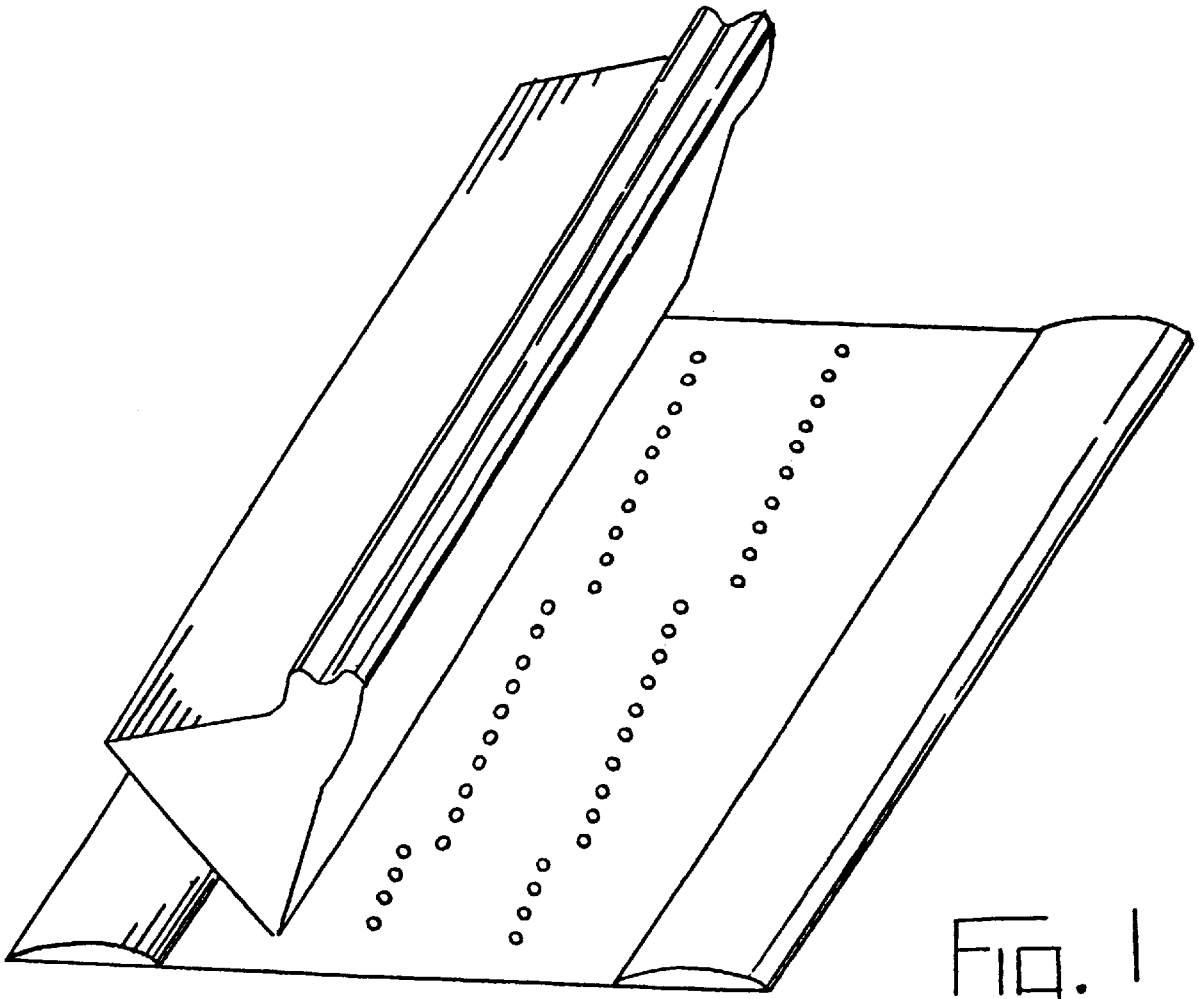
FIG. 1 PRIOR ART
FIG. 1 is a simplified view of a conventional wiping system for cleaning a nozzle plate of an ink jet cartridge assembly.
Figure 2:
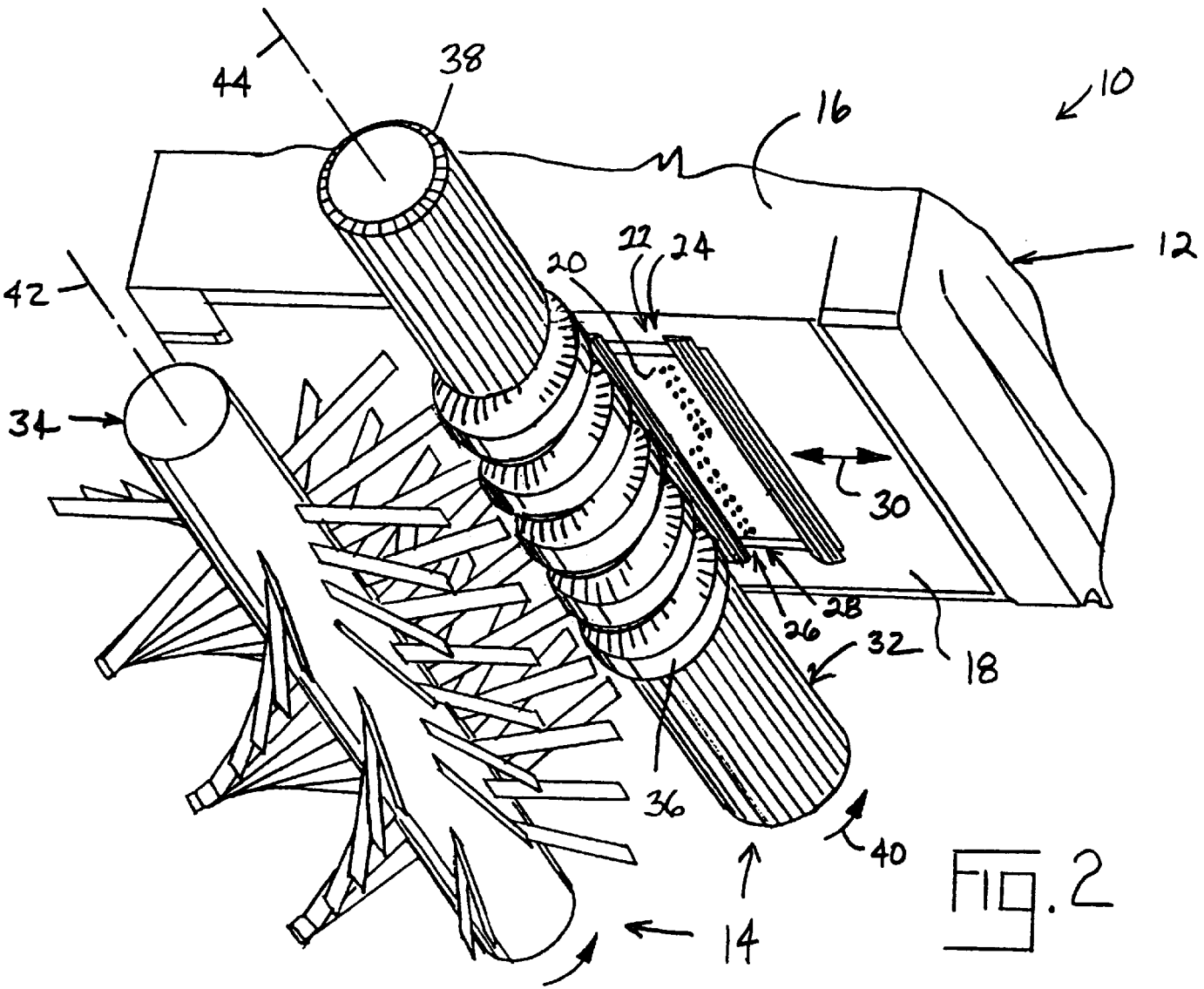
FIG. 2 is a perspective view of a wiping assembly of the present invention.
Figure 3:
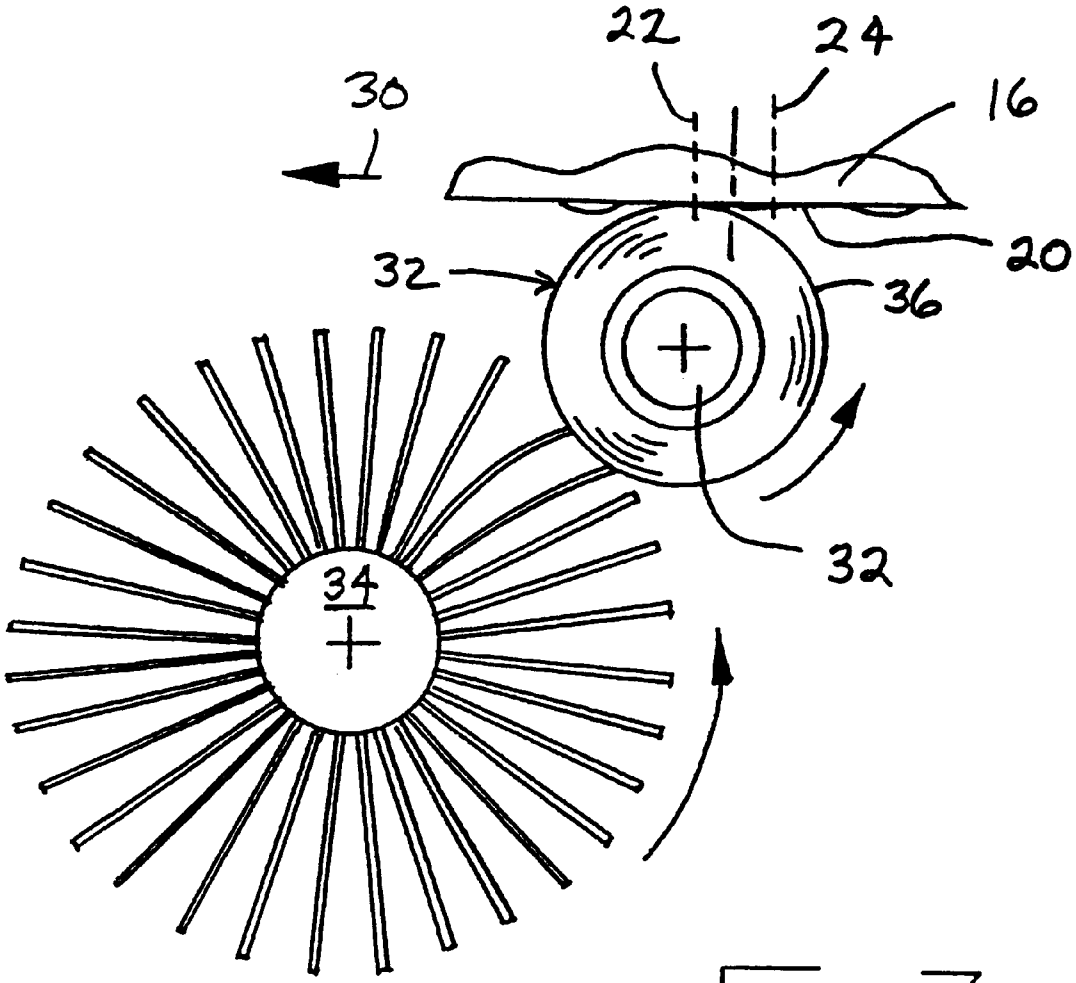
FIG. 3 is an end view of the wiping assembly shown in FIG. 2.

Referring now to the drawings, and particularly to FIGS. 2 and 3, there is shown an embodiment of an ink jet printer 10 of the present invention for printing on a print medium such as paper, transparency, etc. Ink jet printer 10 generally includes an ink jet cartridge assembly 12 and a wiping assembly 14.

Ink jet cartridge assembly 12 includes a body 16 carrying a tape automated bonding (TAB) circuit 18 and nozzle plate 20. Nozzle plate 20 includes a plurality of nozzle arrays 22, 24, 26 and 28. Nozzle arrays 22 and 24 are aligned generally parallel to each other; and nozzle arrays 26 and 28 are also aligned generally parallel to each other. Ink jet cartridge assembly 12 is movable in directions 30 across the width of a print medium and/or into, through and out of a cleaning station. Nozzle arrays 22, 24 and 26, 28 are positioned generally transverse to a selected scan direction 30.

Ink jet cartridge assembly 12 is movable at a scan velocity along a selected scan direction 30. The term "scan" as used herein, is intended to mean movement of ink jet cartridge assembly 12 either during printing, cleaning or initialization. The scan velocity may vary depending upon the particular function being carried out (e.g., single pass printing, shingled printing, cleaning or initialization).

According to an aspect of the present invention, wiping assembly 14 includes a rotary wiper 32 and a rotary brush 34. Rotary wiper 32 is positioned in association with nozzle plate 20 for contacting nozzle plate 20 and removing ink residue and other contaminants therefrom. More particularly, rotary wiper 32 includes a radially outwardly extending wiping edge 36 which is positioned relative to nozzle plate 20 to contact and thereby clean nozzle plate 20. Wiping edge 36 is configured in a helical manner about shaft 38. In the embodiment shown, wiping edge 36 has a generally flat surface which contacts nozzle plate 20, and a pair of radially extending sidewalls extending from the flat surface to shaft 38. However, wiping edge 36 can be differently configured, depending upon the particular application. For example, wiping edge 36 may have a curved or other profile from one application to another.

Rotary wiper 32 is rotatable in a selected rotational direction 40. For example, assuming that ink jet cartridge assembly 12 is moved from the right to the left during a cleaning operation, then rotary wiper 32 is rotated in a counter-clockwise direction to remove ink residue and other contaminants from nozzle plate 20. To ensure that the ink residue and other contaminants are removed and not smeared on nozzle plate 20, rotary wiper 32 is rotated with a tangential velocity at wiping edge 36 which is greater than the scan velocity of ink jet cartridge assembly 12 moving from the right to the left during the cleaning operation. This also ensures that ink residue and other contaminants which are removed from the nozzle array 22 and 26 are not transferred to an adjacent, parallel nozzle array 24 and 28.

In the embodiment shown, rotary wiper 32 is rotated with a tangential velocity which is in the same direction as the scan velocity of ink jet cartridge assembly 12. However, it may also be desirable to rotate rotary wiper 32 with a tangential velocity which is in a direction opposite to the scan velocity of ink jet cartridge assembly 12, depending upon the particular application.

Rotary brush 34 is positioned in association with rotary wiper 32 for contacting rotary wiper 32 and removing the ink residue and other contaminants therefrom. Rotary brush 34 is rotatable about an axis 42 which extends generally parallel to axis 44 of rotary wiper 32. Rotary brush 34 rotates in a direction which is the same as the rotational direction of rotary wiper 32. As shown in FIG. 3, this results in the adjacent surfaces between rotary wiper 32 and rotary brush 34 moving in opposite directions, thereby resulting in efficient cleaning of rotary wiper 32. It is also possible to rotate rotary brush 34 in a direction opposite from rotary wiper 32 such that adjacent surfaces move in a same direction. Configured as such, rotary brush would rotate with a tangential velocity greater than the tangential velocity of rotary wiper 32 SO that ink residue and other contaminants are effectively removed.

During use, ink jet cartridge assembly 12 may be moved in a selected scan direction 30 during a printing, cleaning or initialization operation. During a printing operation, ink jet cartridge assembly 12 is moved across a print medium and ink is selectively jetted from nozzle arrays 22–28 at selected pixel locations on the print medium. During a cleaning operation, ink jet cartridge assembly 12 is moved in a selected scan direction 30 to move ink jet cartridge assembly 12 past rotary wiper 32. Rotary wiper 32 is rotated with a tangential velocity which is in the same direction as the scan direction of ink jet cartridge assembly 12. Moreover, rotary wiper 32 is rotated with a tangential velocity which is greater than the scan velocity of ink jet cartridge assembly 12. Assuming ink jet cartridge assembly 12 is moving from right to left in FIGS. 2 and 3, wiping edge 36 first contacts nozzle array 26 to remove ink residue and other contaminants therefrom. Since the tangential velocity of rotary wiper 32 is greater than the scan velocity of ink jet cartridge assembly 12, the ink residue and other contaminants are moved away from nozzle array 26 to prevent contamination of nozzle array 28. The ink residue and other contaminants are removed from wiping edge 36 of rotary wiper 32 using rotary brush 34. Ink residue and other contaminants are similarly removed from nozzle arrays 22 and 24 using rotary wiper 32 as ink jet cartridge assembly 12 passes thereover.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer for printing on a print medium, comprising:

an ink jet cartridge assembly configured for movement at a scan velocity in scan directions, said ink jet cartridge assembly including a nozzle plate;

a rotary wiper positioned in association with said nozzle plate, said rotary wiper having a radially outwardly extending wiping edge for contacting said nozzle plate, said wiping edge having a generally helical shape extending multiple times around said rotary wiper for contacting said nozzle plate, said rotary wiper being configured for rotation at a tangential velocity which is greater than said scan velocity.

2. The ink jet printer of claim 1, wherein said rotary wiper is rotatable with said tangential velocity being in a same direction as said scan velocity.

3. The ink jet printer of claim 1, said nozzle plate including a plurality of nozzle arrays aligned generally parallel to each other and transverse to said scan directions, said rotary wiper being rotatable about an axis extending transverse to said scan directions.

4. The ink jet printer of claim 1, including a rotary brush positioned in association with said rotary wiper for contacting said rotary wiper, said rotary brush being rotatable about an axis extending generally parallel to said rotary wiper axis.

5. The ink jet printer of claim 4, wherein said rotary brush is rotatable in a same direction as said rotary wiper.

6. A method of cleaning a nozzle plate of an ink jet cartridge assembly in an ink jet printer, comprising the steps of:

moving said ink jet cartridge assembly at a scan velocity in a scan direction;

positioning a rotary wiper in association with said nozzle plate, said rotary wiper having a radially outwardly extending wiping edge for contacting said nozzle plate, said wiping edge having a generally helical shape extending multiple times around said rotary wiper;

rotating said rotary wiper with a tangential velocity which is greater than said scan velocity; and contacting said rotary wiper with said nozzle plate.

7. The method of claim 6, wherein said tangential velocity is in a same direction as said scan velocity.

8. The method of claim 6, wherein said contacting step comprises contacting said wiping edge with said nozzle plate.

* * * * *